US005353982A

United States Patent [19]

Perkins et al.

[11] Patent Number: 5,353,982

[45] Date of Patent: Oct. 11, 1994

[54] FLUENT CONTAINER

[75] Inventors: David W. Perkins, Hiawatha; William L. Chase, Des Moines, both of Iowa

[73] Assignee: Paper Systems, Inc., Des Moines, Iowa

[21] Appl. No.: 6,694

[22] Filed: Jan. 21, 1993

Related U.S. Application Data

[63] Continuation-in-part of Ser. No. 898,927, Jun. 12, 1992, abandoned.

[51] Int. Cl.[5] ..... B65D 13/00

[52] U.S. Cl. ..... 229/23 R; 220/465

[58] Field of Search ..... 220/465, 463, 462, 461; 222/105; 229/23 R, 109, 122, 125.14, 125.15

[56] References Cited

U.S. PATENT DOCUMENTS

| | | | |
|---|---|---|---|
| 1,883,323 | 10/1932 | Andrews . | |
| 3,208,658 | 9/1965 | Membrino | 220/462 |
| 3,363,807 | 1/1968 | Powell | 222/105 |
| 3,756,471 | 9/1973 | Wissman | 220/465 X |
| 4,101,052 | 7/1978 | Dove | 229/117.02 X |
| 4,475,670 | 10/1984 | Rutter | 222/105 X |
| 4,516,692 | 5/1985 | Croley | 222/105 |
| 4,666,059 | 5/1987 | Nordstrom | 220/462 X |
| 4,729,505 | 3/1988 | Remaks et al. . | |
| 4,742,951 | 5/1988 | Kelley et al. | 229/109 X |
| 4,786,192 | 11/1988 | Graves et al. . | |
| 4,850,506 | 7/1989 | Heaps, Jr. et al. | 229/109 X |
| 4,930,644 | 6/1990 | Robbins, III . | |
| 4,934,654 | 6/1990 | Linnemann . | |
| 5,050,775 | 9/1991 | Morquardt | 220/462 X |
| 5,054,644 | 10/1991 | Greenslade | 220/462 X |
| 5,069,359 | 12/1991 | Liebel | 220/462 X |

FOREIGN PATENT DOCUMENTS

| | | | |
|---|---|---|---|
| 2037711 | 7/1980 | United Kingdom | 229/109 |

*Primary Examiner*—Allan N. Shoap
*Assistant Examiner*—Christopher J. McDonald
*Attorney, Agent, or Firm*—Merchant, Gould, Smith, Edell, Welter & Schmid

[57] ABSTRACT

A fluent container and a method of using the fluent container are provided to fixedly and safely secure the discharge fitting of the bag and, therefore, the bag which contains the fluent material, to the bottom of the container. The container has a pre-use configuration convenient for storage which includes a flattened side member and nested cover and bottom members with the bag contained therebetween.

7 Claims, 5 Drawing Sheets

FLUENT CONTAINER

This is a continuation-in-part of application Ser. No. 07/898,927 filed Jun. 12, 1992, now abandoned.

FIELD OF THE INVENTION

The present invention is directed to containers, particularly, multi-walled cardboard containers with a bag liner for retaining fluent material.

BACKGROUND OF THE INVENTION

Cardboard or fiberboard containers for fluent material are known. The containers are commonly placed on a pallet before being filled. The containers commonly have a plastic or otherwise impervious lining bag with an opening at the top and a discharge fitting near the bottom which protrudes from an opening in near the bottom of the container. When the bag is filled, it is closed at the top. A cover is usually placed thereover. The container may or may not be further strapped and retained to the pallet.

Problems with known containers for fluent material include the difficulty of storage of the big empty containers and the securing of the discharge fitting of the liner bag so that it is not stressed relative to the bag during shipping thereby causing ripping or other failure.

Although U.S. Pat. No. 1,883,323 shows a large, octagonal folding box wherein the side member folds flat and the cover fits over the bottom, the box is not designed for containing fluent material. There is no liner and, consequently, no provision for discharge of such material.

U.S. Pat. No. 4,850,506 is directed toward containing fluent material. An octagonal container is shown such that three different side members can be folded flat and the lining bag can be folded between top and bottom plates. The cover is a separate member. The bottom plate includes a flap having an opening for receiving the discharge fitting and shows a tab for pressing against it. Although this container is directed to containing fluent material, it requires a large number of separate pieces which can be troublesome with respect to storing, locating in a warehouse environment and making proper assembly.

SUMMARY OF THE INVENTION

The present invention is directed to a container for large quantities of fluent material which has a single multi-walled side member which can be folded flat for pre-use storage. A flexible bag with a discharge fitting is folded into a bottom member which includes securing mechanism for the discharge fitting. A cover member fits over the bottom member during pre-use storage. Thus, there are only the flattened side member and the nested bottom, bag, and cover which require storage during pre-use. To assemble for use, the multi-walled side member is opened so that the bottom member may be slid from top to bottom, preferably to rest on a pallet. The discharge fitting which is secured to the bottom member, also protrudes from an opening near the bottom of the side member. The flexible bag is opened and its wall draped over the side member or, alternatively, its inlet fitting made available for receiving fluent material. When the bag is filled, the top is appropriately closed and the cover member is placed thereover to complete the container.

Of further advantage, the container of the present invention includes a novel securing mechanism between the bottom member and the discharge fitting on the bag. The bottom member is formed from a square blank to have flaps which bend upwardly relative to the bottom. A flap extension is formed on one of the flaps located in one of the corners of the blanks from material which would otherwise be waste. Provision is made for a square inner portion of the discharge fitting to be received in a square opening in the flap such that the opening contacts three sides of the square portion of the fitting. The flap extension has a notch such that when the extension is folded outwardly and downwardly, the notch also contacts three of the sides of the square portion of the fitting, albeit a different combination of sides than the opening in the flap. In this way, the flap and the flap extension cooperate to secure the discharge fitting, and therefore the bag, with respect to the bottom member and ultimately the container.

In an alternative embodiment, a flap portion and a flap extension portion are disposed on a lock pad to lock the discharge fitting thereto. The flap portion is formed from a square blank wherein the flap extension portion is located in one of the corners of the blank from material which would otherwise be waste. The lock pad contacts the bottom of the bottom member while the fitting extends through an opening in the bottom. Thus, fluent material is fully discharged from the fitting through the bottom of the bottom member.

The present invention achieves solutions to problems with the known art in a way which conserves cardboard or fiberboard material. Furthermore, the invention reduces the number of items which must be stored during pre-use and simplifies assembly. The present invention is discussed in more detail along with its various advantages in the detailed description which references the drawings.

DETAILED DESCRIPTION OF THE PREFERRED EMBODIMENT

Figure 1:
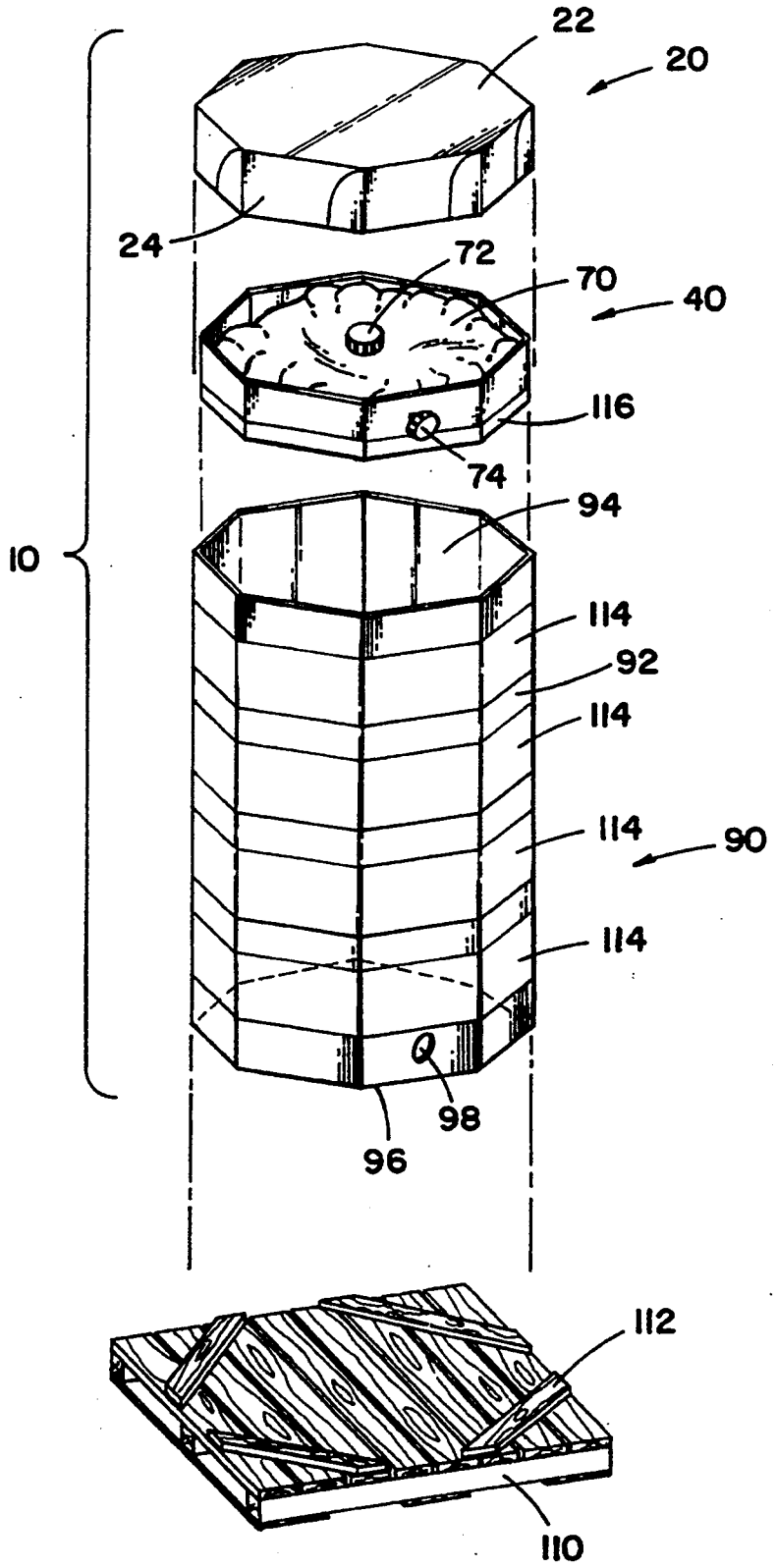
FIG. 1 is an exploded, perspective view of a container in accordance with the present invention.
Figure 2:
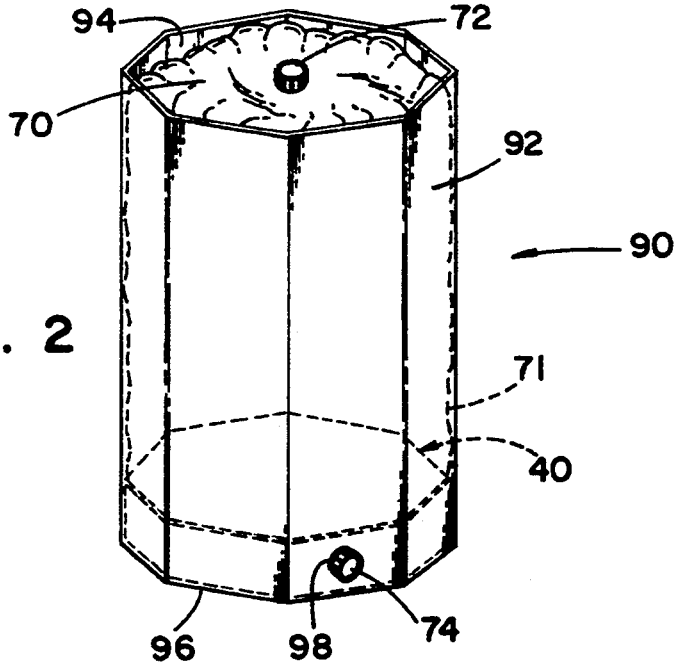
FIG. 2 is a perspective view of the container, except the cover member is not shown.
Figure 3:
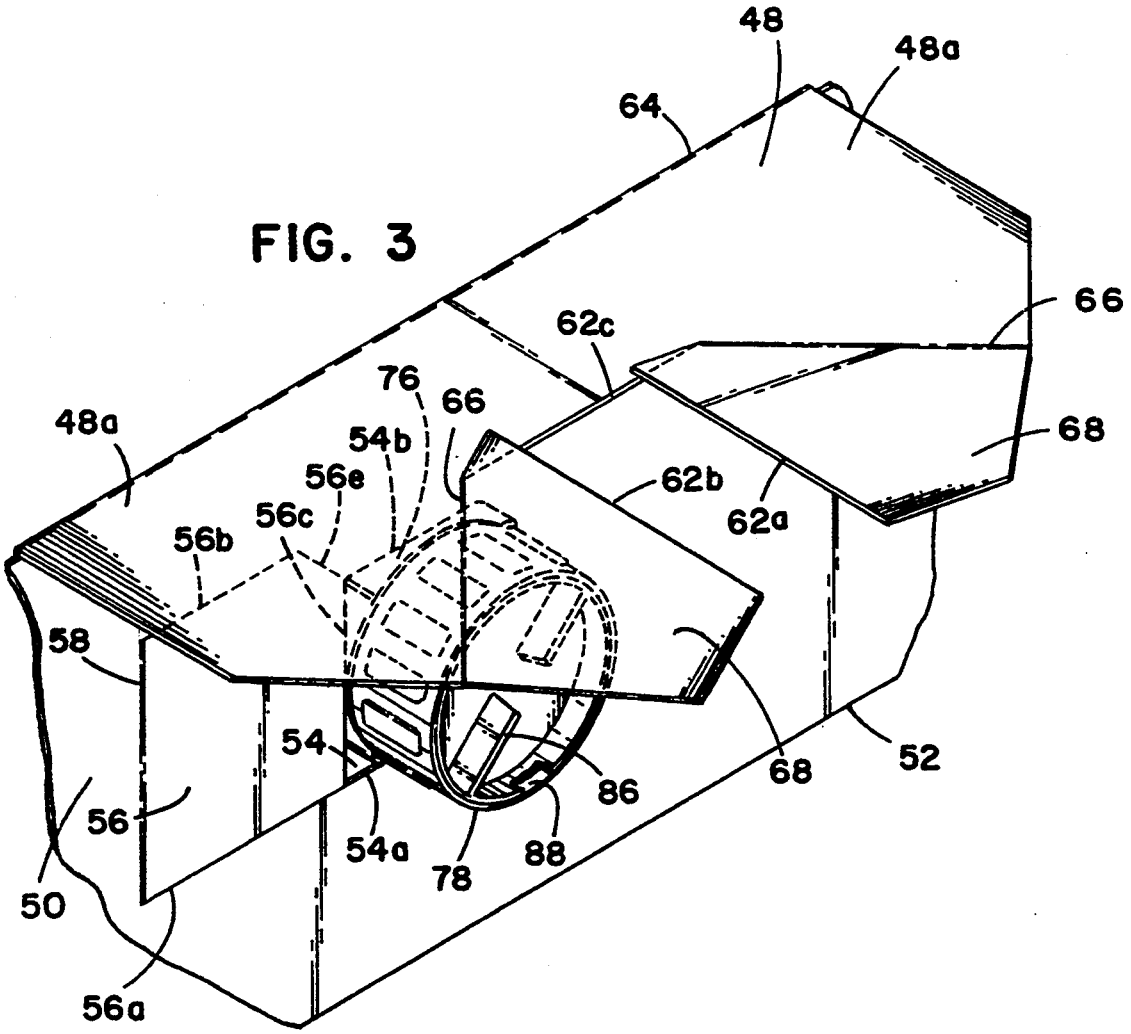
FIG. 3 is a detail view in perspective of the discharge fitting positioned with respect to the bottom flap and flap extension.

Referring now to the drawings wherein like and corresponding reference numerals are used for like or corresponding parts throughout the several views, there is shown in FIG. 1, an exploded, perspective view of a preferred embodiment of a fluent container 10 in accordance with the present invention. Container 10 includes a cover member 20, a bottom member 40, a flexible bag 70, and a multi-walled side member 90. It is common to place container 10 on a pallet 110. Container 10 preferably has an octagonal construction and is commonly made of well known cardboard or fiberboard.

As shown in FIG. 1, flexible bag 70 is foldable into bottom member 40. Bag 70, which can contain large quantities of fluent material, has a wall 71 and can have two fittings. At the top of bag 70, an opening or an inlet fitting 72 can be used to receive fluent material. When bag 70 is filled, opening or inlet fitting 72 is closed appropriately.

A discharge fitting 74 is disposed at substantially the bottom of the side of bag 70. Discharge fitting 74 comprises an inner portion 76 and an outer portion 78. Inner portion 76 includes first and second opposite vertical sides and first and second opposite horizontal sides. Inner portion 76 has width approximately equivalent to the combined thickness of a side flap 50 and a flap extension 48. Outer portion 78 is generally cylindrical having a diameter often equal to a diagonal of the square inner portion 76 or larger. A cap 86 is threadedly mounted on outer portion 78 to close an opening therein. In this regard note that inner portion 76 is readily locked in place due to its square design which in turn easily allows cap 86 to be tightened and loosened without the entire discharge fitting 74 turning. Thus, the fluent material in bag 70 can be discharged under the pressure through an opening area 88 when cap 86 is screwed off.

Multi-walled side member 90 is preferably made of cardboard or fiberboard. An opening 98 is located near the bottom end of one of the walls of side member 92. Outer portion 78 of discharge fitting 74 is received in opening 98. Cover member 20 is formed to fit over first end 94 of side member 90 so as to cover the top end of container 10. Bottom member 40 is formed to fit into second end 96 of side member 90.

Additionally, side member 90 is formed to be flattened or expanded. Thus, when the parts of container 10 are stored for pre-use, multi-walled side member 90 can be flattened so as to save space during storage. When the parts of container 10 are in use, multi-walled side member 90 is expanded. To strengthen side member 90, tape 114 is firmly wound around the outside. It is preferable to use a 12-inch wide tape 114, which requires several rows to completely cover side member 90. Tape 114 can be any of several types. An exemplary tape is the 300 lbs per inch tensile filament tape made by 3M Company (located in St. Paul, Minn.).

In addition, container 10 preferably rests on pallet 110. Cleats 112 are securely mounted on pallet 110 so as to maintain container 10 in a fixed place by retaining bottom member 40. As illustrated in FIG. 1, it is preferable to mount four cleats 112 at approximate by the four corners of pallet 110 so as to fit the octagonal shape of container 10 such that every other edge of the octagon contacts one of cleats 112.

Cover member 20 has a top 22 having sufficient size to fit over the first end 94 of side member 90. First side flaps 24 extend downwardly from top 22 and are glued together in a way known to those so skilled. When cover member 20 fits onto side member 90, first side flaps 24 extend downwardly from top 22 outside of and along the walls of side member 90.

Figure 4:
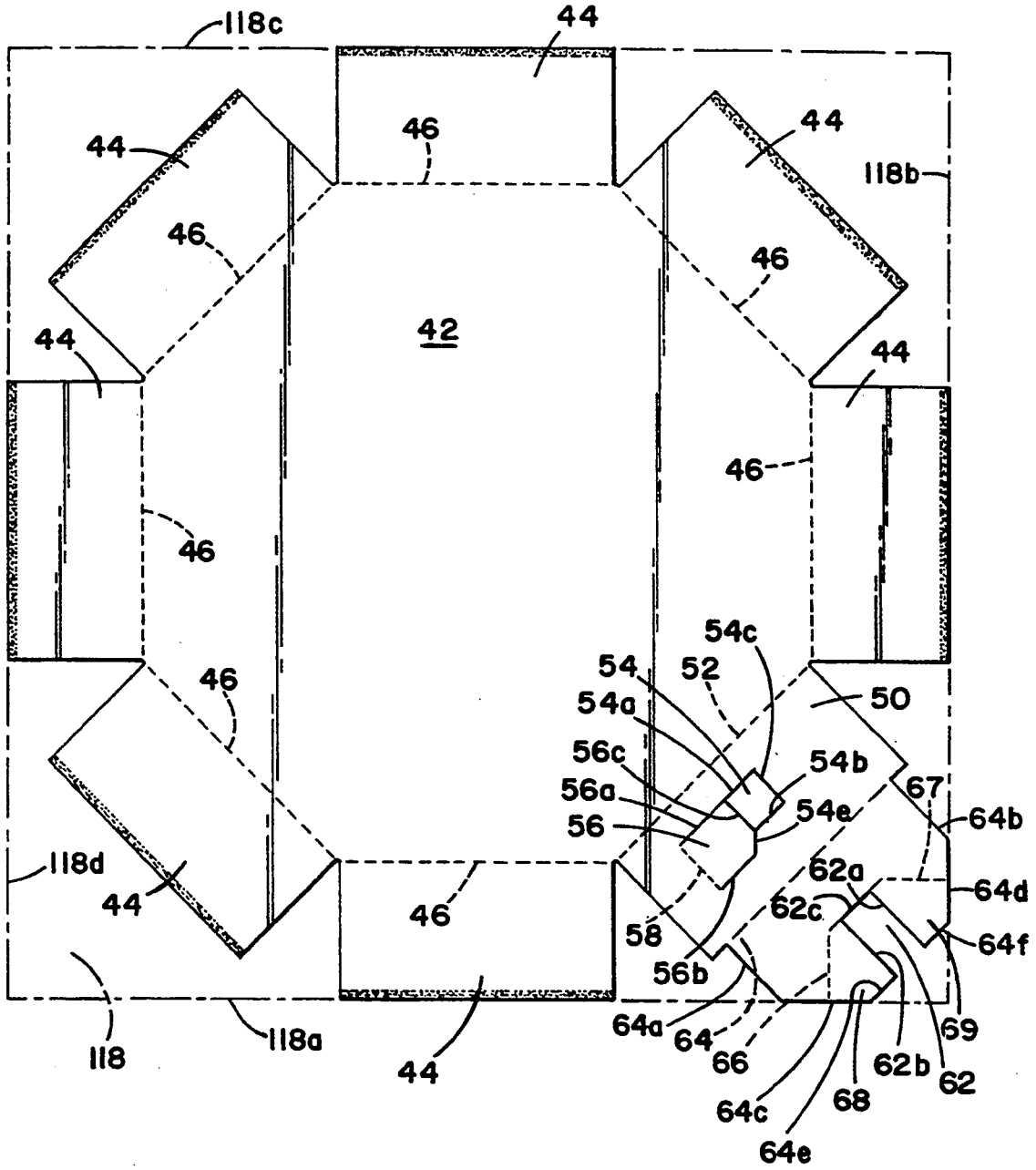
FIG. 4 is a plan view of the bottom member as cut from a square blank.

As shown in FIG. 4, bottom member 40 is formed from a square blank 118 having a bottom 42 and a plurality of flaps 44. In a preferred embodiment, there are eight same size rectangular flaps 44 extended from eight edges of octagonal bottom 42. Eight flaps 44 are defined between edges of square blank 118 and edges of octagonal bottom 42. Four flaps 44 are located at four edges of square blank 118, i.e. 118*a*, 118*b*, 118*c*, 118*d*. Other four flaps 44 are located at four corners of square blank 118. The eight flaps are symmetrical along any diagonal of square blank 118. Flap edges 46 bendably connect bottom 42 with flaps 44 so that flaps 44 can be folded and extended upwardly relative to bottom 42.

Flap 50, one of flaps 44, is connected to bottom 42 by a flap edge 52, one of edges 46. Pincerlike flap extension 48 is extended from flap 50 and bends along a horizonal (relative to flap 50) flap edge 64 which is opposite flap edge 52. With respect to square blank 118, flap extension 48 is located in one of the corners from material which would otherwise be waste.

Square opening 54 preferably centered on flap 50 has horizontal (relative to flap 50) edges 54*a* and 54*b*, and vertical (relative to flap 50) edges 54*c* and 56*c*. Square opening 54 aligns to opening 98 of side member 90.

Pentagonal flap tab 56 on flap 50 is adjacent to square opening 54. Flap tab 56, which is bendable along a vertical (relative to flap 50) flap tab edge 58, is longer than the opposite cut edge 56*c*, one of vertical edges of square opening 54. A horizontal (relative to flap 50) cut edge 56*a*, an extension of edge 54*a*, is longer than an opposite cut edge 56*b* thereby requiring an oblique (relative to flap 50) cut edge 56*e* between edges 56*b* and 56*c* so that a pentagonal area through which outer portion 78 of fitting 74 can pass is formed. Since the size of square opening 54 is smaller than the size of outer portion 78, outer portion 78 can only pass through the pentagonal area defined by bent flap tab 56. Once outer portion 78 has passed through, fitting 74 can be slid toward opening 54 so inner portion 76 is received therein. Vertical edges 56*c* and 54*c*, together with horizontal edges 54*a* and 54*b*, contact and secure the edges of inner portion 76.

Horizontal (relative to flap 50) flap edge 64 of pincerlike flap extension 48 is shorter than flap edge 52. Two vertical (relative to flap 50) edges 64*a* and 64*b* of flap extension 48, which are symmetrical along diagonal of square blank 118, are perpendicular to flap edge 64 and extend toward edges 118*a* and 118*b* of square blank 118. Two oblique edges 64*c* and 64*d* of flap extension 48, which are symmetrical along diagonal of square blank 118, align to edges 118*a* and 118*b*, respectively. A notch 62 is formed in flap extension 48 and has a width the same as square opening 54. Two vertical edges 62*a* and 62*b* of notch 62 align to vertical edges 54*c* and 56*c*, respectively. In a preferred embodiment, edges 62*a* and 62*b* have a same length. One horizontal edge 62*c* of notch 62 aligns to horizontal edge 54*b* when flap extension 48 is folded to flap 50. Edge 62*c* is cut so that edge 62*c* extends to two bendable oblique edges 66 and 67 which are symmetrical along diagonal of square blank 118. Oblique edges 66 and 67 extend respectively from the two ends of the extension of edge 62*c* to oblique edges 64*c* and 64*d* and are substantially perpendicular to oblique edges 64*c* and 64*d*. Two horizontal edges 64*e* and 64*f*, which are parallel to flap edge 64, are formed between edges 64*c* and 62*b*; and edges 64*d* and 62*a*; respectively.

A pentagonal flap extension tab 68 is formed between edges 66, 64*c*, 64*e*, 62*b* and extension of 62*c*. Another flap extension tab 69, which is symmetrical to flap extension tab 68 along diagonal of square blank 118, is formed between edges 67, 64*d*, 64*f*, 62*a* and extension of 62*c*.

Flap extension tabs 68 and 69 bend at edges 66 and 67, respectively, to receive outer portion 78 of discharge fitting 74 more easily and without damaging notch 62 or flap 50. Square opening 54 of flap 50 and notch 62 of flap extension 48 cooperate to secure inner portion 76 of discharge fitting 74 and therefore also to secure bag 70 to bottom member 40. Since inner portion 76 is moved into square opening 54 with a transverse motion and since notch 62 fits onto inner portion 76 with a vertical motion, square opening 54 and notch 62 contact inner portion 76 with a different combination of three edges. In this way, inner portion 76 is more than retained and rather is securely locked in place.

Tape 116 is firmly wound around the outside of bottom member 40. Tape 116 can be any of several types. An exemplary tape is the 300 lbs per inch tensile filament tape made by 3M Company (located in St. Paul, Minn.). It is preferable to use a 2-inch wide tape to wind around the bottom part of the outside of flaps 44 so as to secure bottom member 40 without winding over square opening 54 on flap 50. When installed in side member 90, flaps 44 are inside of and along side walls 92.

In a use configuration, bottom member 40 with bag 70 secured thereto fits inside side member 90 to provide a bottom for container 10, generally as the assembly rests on and is retained to pallet 110. Cover member 20 fits over the top end 94 of side member 90. In a pre-use storage configuration, side member 90 is folded flat and because of the relative sizes of top and bottom members, cover member 20 fits over bottom member 40 with bag 70 therein, thereby requiring a relatively small amount of storage space during pre-use and limiting storage packages to only two subassemblies.

In use, cover member 20 is removed from a position of fitting over bottom member 40. The multi-walled, flattened side member 90 is expanded to open first end 94 and second end 96. Bottom member 40 containing bag 70 is slid inside and along multi-walled side member 90 until discharge fitting 74 reaches opening 98. Discharge fitting 74 passes through opening 98. In this way, bag 70 is fixedly secured to bottom member 40 and accessible through container 10. A portion of bag 70 is opened and bag wall 71 draped over first end 94 of side member 90. Fluent material can then be filled into bag 70. Alternatively, fluent material can be directed into bag 70 through a fitting 72. When bag 70 is filled, it is closed appropriately and cover member 20 is placed onto top end 94 of side member 90. Accordingly, container 10 is formed and filled for safely and securely storing fluent material.

Figure 5:
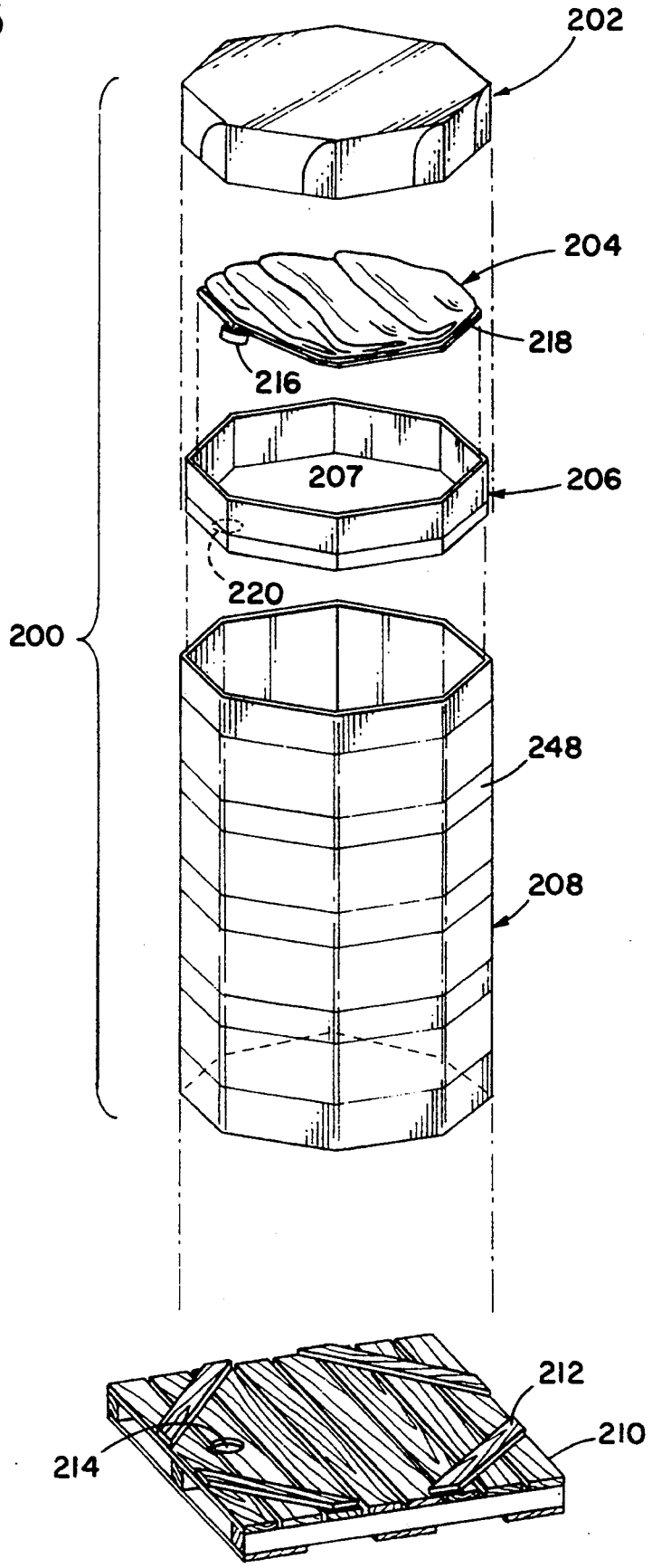
FIG. 5 is an exploded, perspective view of a second embodiment of a container in accordance with the present invention.

Referring to FIG. 5, there is shown an exploded, perspective view of a second embodiment of a container 200 having a cover member 202, a flexible bag 204, a bottom member 206 including a lock pad 218 and a bottom 207, and a side member 208. The container 200 is disposed on a pallet 210 and is secured by four cleats 212 proximate four corners of the top surface of the pallet 210. A clearance hole 214, which receives a discharge fitting 216 of the flexible bag 204, is disposed on the pallet 210 such that fluent material is able to be fully discharged from the flexible bag 204 to outside through the bottom member 206 and the pallet 210.

The cover member 202, the flexible bag 204, and the side member 208 are the same as that of the container 10, except the flexible bag 204 of the container 200 has the discharge fitting 216 at the bottom as opposed to on the side. In addition, the lock pad 218 is attached to the bottom 207 of the flexible bag 204 and locks the discharge fitting 216 in place. Further, an opening 220 for receiving the discharge fitting 216 is disposed on the bottom of the bottom member 206 as opposed to being disposed on the side of the bottom member 40. Opening 220 is exposed by severing along a scored line, a filler member from bottom 207.

Figure 8:
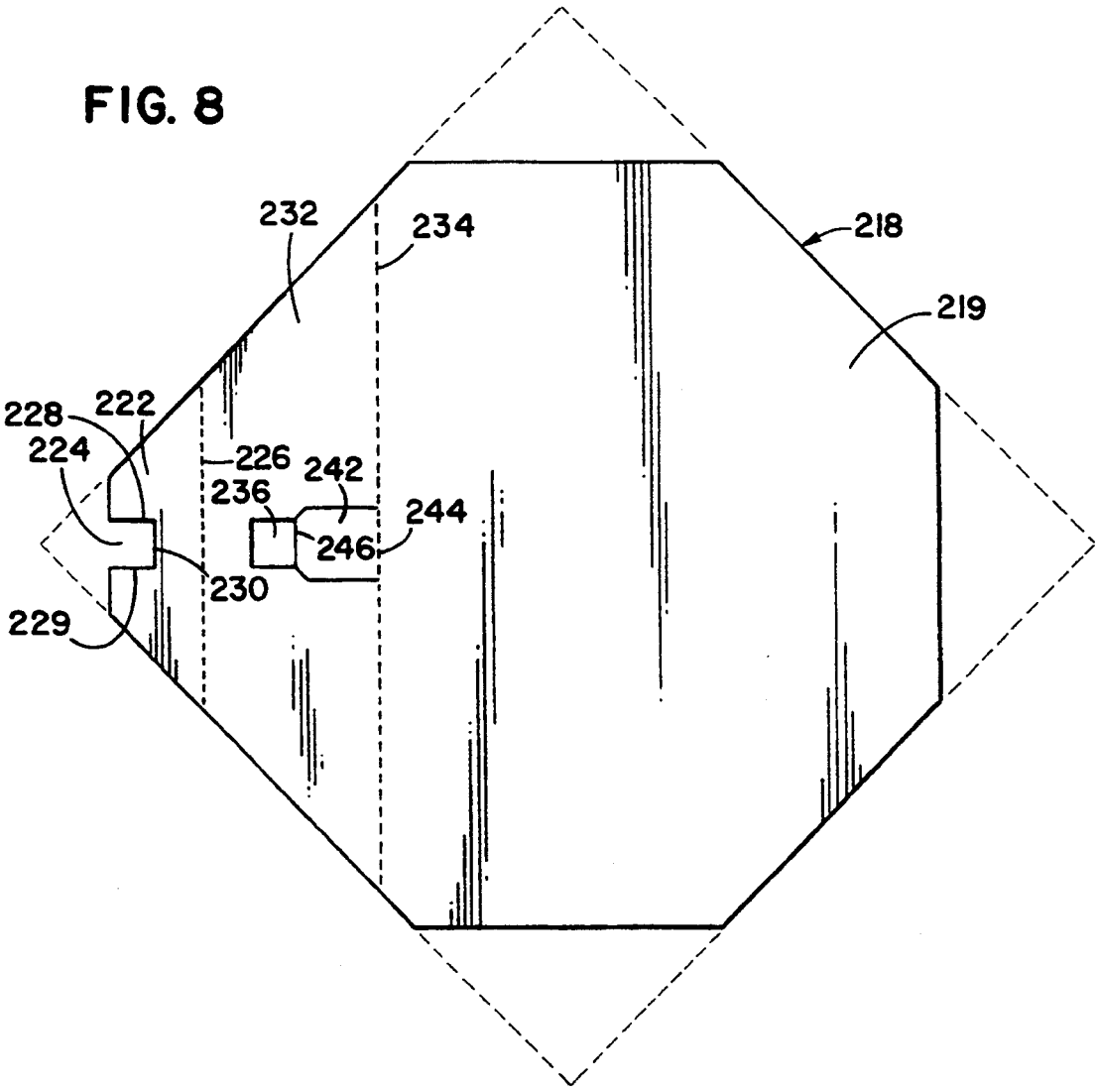
FIG. 8 is an enlarged, plan view of the lock pad.

FIG. 8 shows an enlarged view of the lock pad 218. The lock pad 218 is formed from a square blank and is cut to form a proximate octagonal-shape board 219. A flap extension portion 222, having a notch 224, is bendably extended from a folding edge 226 of the board 219. It is appreciated that the notch 224 has a rectangular shape including three edges 228,229,230 and opens opposite to the edge 230 which is closest to folding edge 226. The notch 224 is the same as the notch 62 used in the container 10.

The board 219 further includes a flap portion 232 which has the folding edge 226 connected to the flap extension portion 222 and a folding edge 234 connected to the remaining portion of the board 219 which is inwardly from the folding edge 226. An opening 236 on the flap portion 232 is symmetrical to the notch 224 relative to the folding edge 226. It is appreciated that the opening 236 is a square shape opening wherein three edges of the square opening align to the edges 228,229,230 when the flap extension portion 222 is folded over the flap portion 232. The size of the square opening 236 is smaller than an outer portion 238 of the discharge fitting 216 and is the same as the size of an inner portion 240 of the discharge fitting 216 (see FIG. 6). A flap tab 242 on the flap portion 232 has a flap tab edge 244 on the folding edge 234 so that the flap tab 242 is able to be folded along the flap tab edge 244. A cutting edge 246 which is opposite to the edge 244 is aligned to the fourth edge of the square opening 236. The edge 246 has the same length as the edges of the square opening 236. The size of an area defined by the flap tab 242 is large enough to allow the outer portion 238 of the discharge fitting to pass through. Thus, once the outer portion 238 has passed through the area defined by the flap tab 242, the discharge fitting 216 can be slid toward the square opening 236 so the inner portion 240 is received therein. The edges of the square opening 236, together with the cutting edge 246, contact the edges of the inner portion 240.

When the flap extension portion 22 is folded along the folding edge 226, the edges 228,229,230 of the notch 224 contact and secure the inner portion 240 in place.

Figure 6:
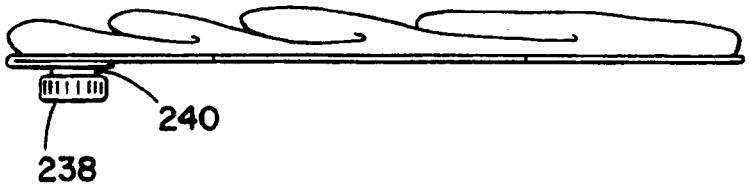
FIG. 6 is a side view of a flexible bag with a lock pad locking the flexible bag which is shown in FIG. 5.

Referring to FIG. 6, the flexible bag 204 contacted and secured by the lock pad 218 is shown. When the flexible bag 204 is empty or not in use, the flexible bag 204 rests on the lock pad 218.

Figure 7:
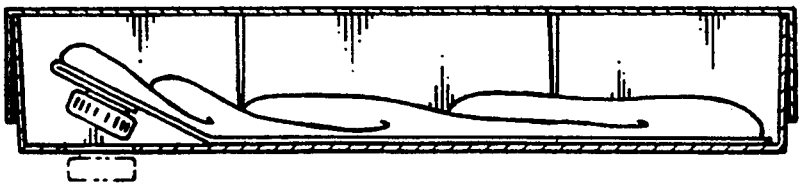
FIG. 7 is a cross-sectional view of the flexible bag with the lock pad stored between a cover and bottom members when the container is not in use.

FIG. 7 shows the flexible bag 204 and the lock pad 218 stored in a box formed by the cover member 202 fitting onto the bottom member 206. The lock pad 218 is folded upwardly along the folding edge 234 so that the discharge fitting 216 is disposed inside the box. The dash line shows the discharge fitting 216 extending through the opening 220 of the bottom member 206 thus being disposed outside of the box wherein the lock pad 218 is not folded. When the container 200 is not in use, the side member 208 is folded in flat shape.

When the container 200 is in use, the box is opened. The side member 208, which is wound by a plurality of tapes 248, is expanded and bottom member 206 is slid through member 208. Discharge fitting 216 is extended through opening 220. When fluent material is filled in flexible bag 204, the cover member 202 is placed over the top end of side member 208. It is appreciated that the container 200 is positioned on the pallet 210 wherein the container 200 is secured by the cleats 112 and the discharge fitting 216 is received by the clearance hole 114 so that fluent material is discharged through the clearance hole 114.

Thus, the preferred embodiment of the present invention has been described in detail. It is understood, however, that the disclosure is exemplary and that equivalents are possible. Changes made, therefore, especially in matters of shape, size, and arrangement of the various parts to the full extent extended by the general meaning of the terms in which the appended claims are expressed, are understood to be within the principle of the invention.

What is claimed is:

1. A container for large quantities of fluent material, comprising:

a side member with a plurality of walls, said side member having open first and second ends;

a cover member having a top which extends across said first end of said side member;

a flexible bag with a discharge fitting, said fitting having an inner portion and an outer portion;

means for extending across said second end of said side member, said extending means including a formed formable from a square piece of material, said formed member further including means for locking the fitting, the locking means comprising a flap portion and a flap extension portion which bendably extends from a first edge of said flap portion, said flap extension portion being formed from said corner of said square piece in material which would otherwise be waste, said locking means further including first means in said flap portion and second means in said flap extension portion for cooperating with one another to secure said inner portion of said discharge fitting with respect to said formed member.

2. The container in accordance with claim 1 wherein said inner portion of said discharge fitting includes first and second vertical sides and first and second horizontal sides, said first cooperating means including means for passing therethrough said outer portion of said discharge fitting and means for contacting the first of said vertical sides and the first and second of said horizontal sides of said inner portion whereby said second cooperating means with said contacting means secures the first and second vertical sides and the first and second horizontal sides relative to said one side flap portion and said flap extension portion.

3. The container in accordance with claim 2 wherein said passing means includes said flap portion comprising a flap tab and all remaining portions of said flap portion, said flap tab being bendable at said flap tab edge with respect to said remaining portions, said flap tab defining an area through which said outer portion of said discharge fitting can pass and said inner portion can occupy.

4. The container in accordance with claim 3 wherein said contacting means includes a second opening adjacent to said area defined by said flap tab, said second opening having second opening edges contacting three of said first and second vertical edges and said first and second horizontal edges of said discharge fitting whereby said passing means passes said outer portion of said discharge fitting therethrough and receives said inner portion so that said inner portion can be moved from said area defined by said flap tab into said second opening.

5. The container in accordance with claim 4 wherein said second cooperating means includes a notch in said flap extension portion having notch edges contacting a different combination of three than said second opening edges of said first and second vertical edges and said first and second horizontal edges.

6. The container in accordance with claim 5 wherein said second cooperating means further including said flap extension portion having flap extension tabs and remaining portions, said flap extension tabs being bendable at extension tab edges with respect to said remaining portions and being on opposite sides of said notch to more easily receive said inner portion of said discharge fitting in said notch.

7. The container in accordance with claim 1 wherein said extending means includes a lock pad and a bottom, said bottom including an opening therein, said outer portion of said discharge fitting passing through said opening, said flap portion and said flap extension portion being disposed on said lock pad to secure said discharge fitting to said lock pad.

* * * * *

UNITED STATES PATENT AND TRADEMARK OFFICE

CERTIFICATE OF CORRECTION

PATENT NO. : 5,353,982

DATED : Oct. 11, 1994

INVENTOR(S) : Perkins et al.

It is certified that error appears in the above-indentified patent and that said Letters Patent is hereby corrected as shown below:

Column 7, line 27, insert--member-- after the word "formed".

Column 8, line 33, insert--portion-- after the word "extension".

Signed and Sealed this

Third Day of October, 1995

*Attest:*

Bruce Lehman

BRUCE LEHMAN

*Attesting Officer*

*Commissioner of Patents and Trademarks*